US008443706B2

(12) United States Patent
Egres, Jr.

(10) Patent No.: US 8,443,706 B2
(45) Date of Patent: May 21, 2013

(54) TRIAXIAL BRAID FABRIC ARCHITECTURES FOR IMPROVED SOFT BODY ARMOR BALLISTIC IMPACT PERFORMANCE

(75) Inventor: Ronald G. Egres, Jr., Midlothian, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 77 days.

(21) Appl. No.: 13/226,583

(22) Filed: Sep. 7, 2011

(65) Prior Publication Data

US 2013/0055882 A1 Mar. 7, 2013

(51) Int. Cl.
*D04C 1/06* (2006.01)

(52) U.S. Cl.
USPC ..... 87/8; 87/13

(58) Field of Classification Search
USPC ..... 87/8, 13; 139/383 R
See application file for complete search history.

(56) References Cited

U.S. PATENT DOCUMENTS

| | | | | |
|---|---|---|---|---|
| 1,368,215 | A | | 2/1921 | Stewart |
| 3,094,511 | A | | 6/1963 | Hill, Jr. et al. |
| 3,354,127 | A | | 11/1967 | Hill, Jr. et al. |
| 3,446,251 | A | | 5/1969 | Dow |
| 3,673,143 | A | | 6/1972 | Bair et al. |
| 3,767,756 | A | | 10/1973 | Blades |
| 3,819,587 | A | | 6/1974 | Kwoleck |
| 3,869,429 | A | | 3/1975 | Blades et al. |
| 3,869,430 | A | | 3/1975 | Blades et al. |
| 3,874,422 | A | | 4/1975 | Dow et al. |
| 4,172,938 | A | | 10/1979 | Mera et al. |
| 4,191,219 | A | * | 3/1980 | Kaye ..... 139/383 R |
| 4,403,012 | A | | 9/1983 | Harpell et al. |
| 4,438,173 | A | | 3/1984 | Trost |
| 4,457,985 | A | | 7/1984 | Harpell et al. |
| 4,501,854 | A | | 2/1985 | Singer et al. |
| 4,543,286 | A | | 9/1985 | Harpell et al. |
| 4,563,392 | A | | 1/1986 | Harpell et al. |
| 4,623,574 | A | | 11/1986 | Harpell et al. |
| 4,650,710 | A | | 3/1987 | Harpell et al. |
| 4,681,792 | A | | 7/1987 | Harpell et al. |

(Continued)

FOREIGN PATENT DOCUMENTS

WO 0008411 A1 2/2000

OTHER PUBLICATIONS

Hearle et al., Ballistic Impact Resistance of Multi-layer Textile Fabrics, 1981.

(Continued)

*Primary Examiner* — Shaun R Hurley

(57) ABSTRACT

A fabric comprising a first plurality of yarns, a second plurality of yarns and a third plurality of yarns wherein the first, second and third pluralities of yarns have a yarn orientation that is different from each other. The third plurality of yarns is oriented in an axial direction. The second plurality of yarns is interwoven with the first plurality of yarns. The third plurality of yarns have no crimp. The yarns of the second plurality of yarns have an average linear density greater than or equal to the average linear density of the yarns of the first plurality of yarns and the yarns of the third plurality of yarns have an average linear density greater than the average linear density of the yarns of the second plurality of yarns and less than three times the average linear density of the yarns of the first plurality of yarns.

4 Claims, 1 Drawing Sheet

U.S. PATENT DOCUMENTS

| | | | | |
|---|---|---|---|---|
| 4,737,401 | A | 4/1988 | Harpell et al. | |
| 4,748,064 | A | 5/1988 | Harpell et al. | |
| 4,916,000 | A | 4/1990 | Li et al. | |
| 5,101,556 | A * | 4/1992 | Fluga et al. | 29/888.046 |
| 5,437,538 | A | 8/1995 | Mitchell | |
| 5,619,903 | A * | 4/1997 | Rogers et al. | 87/7 |
| 5,677,029 | A | 10/1997 | Prevorsek et al. | |
| 5,899,134 | A * | 5/1999 | Klein et al. | 87/9 |
| 6,119,575 | A | 9/2000 | Dragone et al. | |
| 8,122,809 | B2 * | 2/2012 | Simpson | 87/11 |
| 2003/0109188 | A1 | 6/2003 | Hartert et al. | |

OTHER PUBLICATIONS

Yen et al., 3D Woven Composites for New and Innovative Impact and Penetration Resistant Systems Technical Progress Report, Material Sciences Corporation, prepared for U.S. Army Research Office, 5 Contract No. DAAD19-00-C-0107, 2001.

Black et al., Man-Made Fibres—Science and Technology, vol. 2, in the section titled Fibre-Forming Aromatic Polyamides, 1968, p. 297, Interscience Publishers.

Revilock et al., FAA Development of Reliable Modeling Methodologies for Fan Blade Containment Analysis, NASA Gleen Research Center, Date Unknown, as confirmed on Feb. 20, 2013 by Applicant in his response.

* cited by examiner

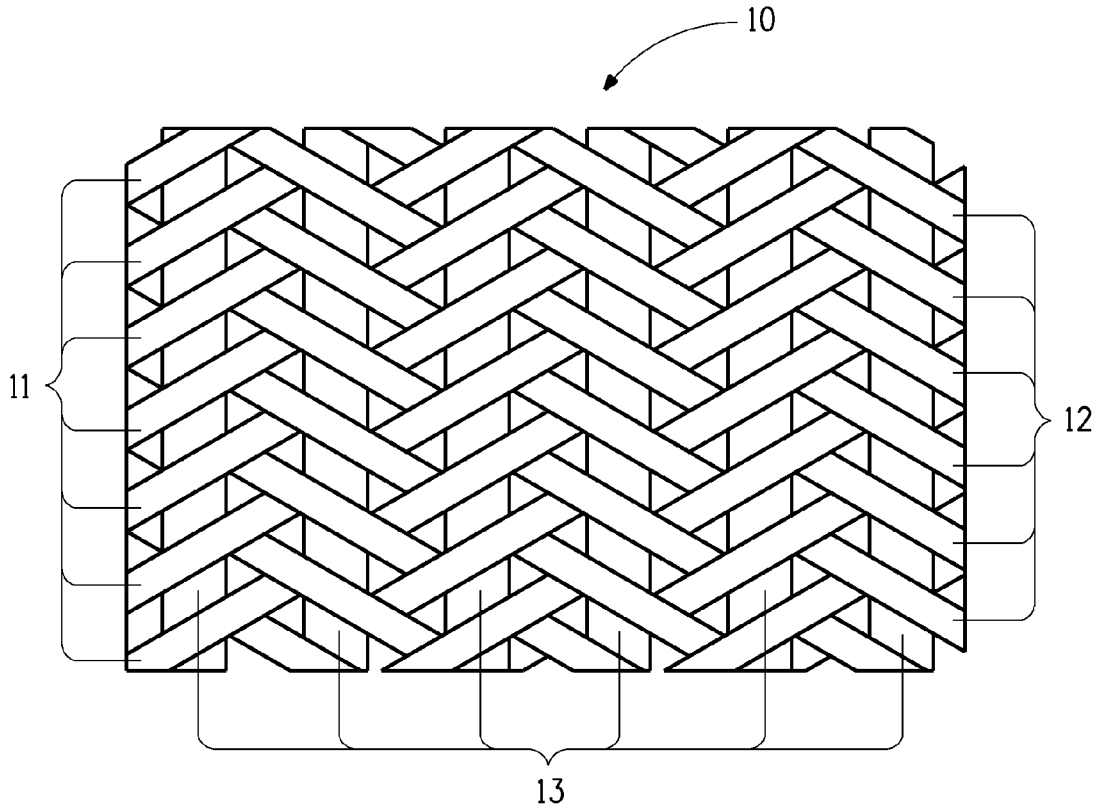
10
11
12
13

TRIAXIAL BRAID FABRIC ARCHITECTURES FOR IMPROVED SOFT BODY ARMOR BALLISTIC IMPACT PERFORMANCE

BACKGROUND OF THE INVENTION

1. Field of the Invention

The present invention relates to fabric architectures and soft body armor constructed therefrom.

2. Description of the Related Art

Protective body armors such as those providing protection against ballistic and stab type threats have long been an area of significant interest. One challenge for body armor manufacturers is to provide adequate protection from a particular threat or threats that the wearer may be subjected to in the field, while minimizing the weight, or areal density of the protective garment so as not to impede the dexterity of the wearer.

Characterization of the protective capabilities of any armor material against ballistic projectile threats, such as deformable bullets and non-deformable shrapnel fragments, requires some determination of the ballistic velocity limit with respect to the material's areal density and size, as well as the properties of the projectile (mass, hardness, shape, etc.). One common ballistic limit performance criteria is the ballistic V50, or the velocity at which 50% of the projectiles can be defeated by the armor. Specific testing and calculation protocols for determining V50 of body armors are outlined by the National Institute of Justice (NIJ) Standard 0101.06 Ballistic Resistance of Personal Body Armor, dated Jul. 2008. Beyond the ability of armor to stop the penetration of a projectile, the need to minimize blunt trauma associated with the ballistic impact for concealable body armors worn by police, security, and correctional officers, becomes an additional safety requirement set forth by NIJ Standard 0101.06. This standard outlines the testing protocol and performance requirements for an acceptable level of blunt trauma through measurement of the Back Face Deformation associated with ballistic impact of armors placed upon a clay witness simulation material. In NIJ Standard 0101.06, the acceptable amount of Back Face Deformation is defined as being no greater than 44 mm in a clay witness (Roma Plastilina clay, 5.5 in (140 mm) clay witness depth).

The NIJ Standard 0101.06 defines ballistic requirements specific to different types of projectiles and impact energy levels. Three common NIJ threat levels for soft body armor include Threat Level II, IIA, and IIIA. Threat level II relates to higher velocity 357 magnum, 10.2 g (158 gr) and 9 mm, 8.0 g (124 gr) bullets (impact velocities of less than about 1400 ft/s (427 m/s) and 1175 ft/s (358 m/s), respectively). Level IIA relates to lower velocity 40 S&W caliber full metal jacket bullets, with a nominal mass of 11.7 g (180 gr) and 9 mm 8.0 g (124 gr) bullets, (impact velocities of less than about 1025 ft/s (312 m/s) and 1090 ft/s (332 m/s), respectively). Threat level IIIA relates to 44 magnum, 15.6 g (240 gr) and sub machine gun 9 mm (124 gr) bullets having impact velocities of less than about 1400 ft/s).

In addition to the bullet type deformable threats described above, many types of body armors must also demonstrate the ability to stop non-deformable fragmentation type threats, such as those associated with the detonation of explosives.

The development of flexible body armor systems with multi-threat ballistic resistance to bullets and fragmentation threats as well as providing adequate blunt trauma protection against high energy bullets such as the 44 Magnum often require hybrid constructions of two or more high strength fiber ply structures with each type of ply structure being specifically suited for the defeat of a particular class of threat or impeding Back Face Deformation. This approach to soft body armor development can become an inefficient development strategy as body armor requirements drive toward increased protection against a diverse and growing variety of threats, while simultaneously trying to reduce the overall areal density of the body armor.

While the ballistic performance requirements set forth above can be achieved using any of several commercially available anti-ballistic materials, either alone or in combination, the challenge for soft body armor manufacture is the selection and arrangement of ballistic layers required to (1) prevent penetration with an acceptable safety margin, (2) minimize Back Face Deformation, (3) minimize the weight, bulk and stiffness of the armor to improve comfort and (4) reduce cost.

Commercially available anti-ballistic materials include a variety of woven fabrics, fabric reinforced composites, unidirectional fiber laminates and nonwovens. Of these various constructions, woven fabrics fabricated from high tenacity fiber yarns have the longest history of use in soft body armor fabrication. Weaving has long been a relatively inexpensive means of uniformly generating fabric ballistic resistant plies from high tenacity fiber yarns, relying on mechanical interlocking or "interlacing" of the yarns to hold the yarns in place instead of chemical locking by adhesive resins which can contribute additional weight and stiffness to a garment. Soft body armors fabricated from ballistic resistant fabrics are very often more conformable and flexible during use, providing greater comfort than hybrid armors containing stiff back-face control layers such as unidirectional fiber laminates or resin impregnated fabrics. Additionally, it has been shown that ballistic resistant garments generated entirely of woven high tenacity fiber yarns maintain ballistic resistant properties after years of service and wear. Alternatives to an all woven ballistic resistant vest are in commerce. Such articles are prepared from combinations of high tenacity fibers, matrix resins and films, often making them more costly to produce. Additionally, by virtue of the component materials having temperature and strain dependent physical properties (eg. coefficient of thermal expansion, modulus, etc.) dissimilar to that of the ballistic fiber, these composite layers often have a useable life cycle dictated by the weakest of the materials selected.

Typical biaxial woven ballistic resistant fabrics (fabrics consisting of interwoven or interlaced yarns having two yarn orientations within the plane of the fabric) are generated on automated looms. These looming operations generate woven fabrics having interwoven fill fiber yarns oriented 90 degrees to those yarns in the warp, or machine direction. The fabric properties are largely governed by five basic variables: yarn mechanical properties, yarn denier, yarn count, weave pattern and fabric finish. Meeting the minimum ballistic performance requirements using only the above woven fabrics presents a challenge for ballistic armor manufacturers. While many low cover factor (loosely woven) ballistic resistant fiber yarn fabrics provide satisfactory V50 performance at the desired areal density (vests fabricated therefrom can be shown to repeatedly impede projectiles from penetrating the vest material at velocities safely above the threshold values outlined in NIJ Standard 0101.06), they do not provide adequate Back Face Deformation resistance. Conversely, the use of higher cover factor (more tightly woven) ballistic resistant fabrics at the same vest areal density while improving Back Face Deformation performance, often results in significant reduction in V50 performance, sometimes falling below the NIJ Standard 0101.06 velocities required for Back Face Deformation measurement. Currently no all p-aramid woven fabric vests are available commercially at an areal density of less than 4.93 kg/sq.m. (1 lb/sq.ft.) that can meet the NIJ Standard 0101.06 level IIIA backface requirement for a 44 magnum ballistic threat.

One common method for reducing the Back Face Deformation in soft body armors is through incorporating rigid plies of high tenacity fiber or fabric reinforced resin composite plies to impede deformation during impact. This includes bonding polymeric films or applying polymeric coatings to woven ballistic fabrics, or bonding two woven fabric layers to provide an anti-ballistic ply that can be added to ballistic body armor constructions to improve Back Face Deformation. Such an approach is described in PCT publication WO 00/08411, U.S. Pat. No. 5,677,029, and US patent application publication 2003/0109188. Resin or elastomer impregnated ballistic fiber fabric is another type of composite ply added to ballistic vest constructions to improve ballistic Back Face Deformation. While the addition of these layers has been shown to improve the Back Face Deformation performance of an armor material, they can often have a deleterious effect on V50 performance. In addition, the resin adds to the weight and stiffness of the ballistic vest assembly.

Unidirectional fiber laminates, comprised of a first plurality of parallel oriented high tenacity fibers in a polymeric matrix adhesively bound to a second plurality of parallel oriented high tenacity fibers in a polymeric matrix, where the fiber orientation of the second plurality is 90 degrees rotated relative to the orientation of the first plurality, have become popular anti-ballistic materials that can provide good backface trauma control while maintaining safe V50 performance. Methods of making these unidirectional fiber laminates are generally described in U.S. Pat. Nos. 4,916,000; 4,748,064; 4,737,401; 4,681,792; 4,650,710; 4,623,574; 4,563,392; 4,543,286; 4,501,854; 4,457,985, and 4,403,012. These unidirectional laminates are commercially available under the trade names Spectra Shield® Plus Flex, and Gold Flex™, from Honeywell International, Inc. and Dyneema®UD from DSM. While these unidirectional fiber laminates can be used alone to provide ballistic protection against some ballistic threats, it has been shown that further reductions in areal density and protection against a broad range of threats can be achieved when these materials are used in conjunction with woven ballistic fiber yarn fabrics, as illustrated in U.S. Pat. No. 6,119,575.

Performance improvements associated with using unidirectional fiber or fabric and resin composite layers in vests can be very dependent on their location within the multi-ply construction, as discussed in U.S. Pat. No. 6,119,575. In many documented instances, the placement of these stiffer composite layers behind traditional ballistic fabrics provides the optimum in Back Face Deformation and V50 performance. Due to this "sidedness" these hybrid ballistic vest constructions can be inadvertently worn inside-out, or inserted the wrong way into a tactical vest, providing less than optimal protection from projectile threats. Hence there is value in monolithic (comprised of all the same plies of anti-ballistic material) or front-back symmetric ballistic resistant armor constructions.

Triaxial fabrics, or woven fabrics comprised of three yarns are known. U.S. Pat. No. 1,368,215 to Stewart, U.S. Pat. Nos. 3,446,251 and 3,874,422 to Dow, and U.S. Pat. No. 4,438,173 to Trost all teach triaxial fabric structures. In U.S. Pat. No. 5,437,538 to Mitchell, the use of triaxial braided fabrics generated from Kevlar® fiber in blade containment projectile shield structures for gas turbine engines is disclosed. While no impact test method is provided in U.S. Pat. No. 5,437,538, Mitchell discloses that the ballistic resistance of a multi layered containment shield comprised of the triaxial braided fabric demonstrated containment performance comparable to a conventional woven fabric containment shield at a weight savings of 23%. Typical ballistic impact testing to determine the performance of turbine engine containment shields utilize relatively large projectile simulators at sub-sonic impact velocities representative of spall from fractured aircraft turbine blades, as described in the report "FAA Development of Reliable Modeling Methodologies for Fan Blade Out Containment Analysis" (Authors: Revilock and Pereira, NASA Glenn Research Center). It is well understood in the field of armor development that the impact physics associated with these large sized and low velocity (sub-sonic) projectiles is very different from that of significantly smaller and higher (supersonic) projectiles such as bullets and blast fragmentation from explosives.

Experimental investigations and computer simulations describing the resistance of triaxial fabric targets to bullet and fragmentation ballistic threats at super sonic velocities of importance to body armor design exist in the literature. In the work of Hearle et al. (Hearle, J. W. S., C. M. Leech, A. Adeyefa, C. R. Cork. 1981 "Ballistic Impact Resistance of Multi-layer Textile Fabrics") the experimental results of the triaxial fabrics tested demonstrate inferior high velocity fragmentation ballistic resistance compared to biaxial fabrics. Computer simulations in the second part of the report by Hearle and coworkers further predict that the ballistic performance of triaxial fabrics should be inferior to the performance of typical biaxial woven fabrics for high velocity bullet and fragmentation threats. The published results from ballistic impact simulations performed on woven fabric composite constructions by Yen and Caiazzo (Yen, C. F., and A. A. Caiazzo. 2001 "3D Woven Composites for New and Innovative Impact and Penetration Resistant Systems" Technical Progress Report, Material Sciences Corporation, prepared for U.S. Army Research Office, Contract No. DAAD19-00-C-0107) also indicate that the impact resistance of triaxial braided fabrics are inferior to that of biaxial fabrics.

The need still exists for a lightweight body armor comprised of fabrics that can stop penetration and reduce the blunt trauma associated with high energy bullets, and, at the same time, provide improved protection against high velocity fragmentation threats. This is currently a challenge for body armor comprised entirely of traditional biaxial woven fabrics. The inventive triaxial braid fabric architectures described herein have demonstrated ballistic resistance improvement over conventional biaxial and other woven fabrics when tested against high velocity (super-sonic) high energy bullets and fragmentation projectiles, which is unanticipated by earlier impact investigations of triaxial woven fabrics.

SUMMARY OF THE INVENTION

The invention is directed to a triaxial braided fabric comprising a first plurality of yarns oriented parallel to each other within the plane of the fabric, a second plurality of yarns oriented parallel to each other within the plane of the fabric and a third plurality of yarns oriented parallel to each other within the plane of the fabric wherein, (i) the first, second and third pluralities of yarns have a yarn orientation that is different from each other, (ii) the second plurality of yarns is interwoven with the first plurality of yarns, (iii) the third plurality of yarns is not interwoven with either the first or second pluralities of yarns, (iv) each yarn of the first plurality of yarns passes, in a repeat pattern and in order, over one yarn of the second plurality of yarns, over one yarn of the third plurality of yarns, over one yarn of the second plurality of yarns and then under one yarn of the second plurality of yarns, under one yarn of the third plurality of yarns and then under one yarn of the second plurality of yarns, (v) each yarn of the second plurality of yarns passes, in a repeat pattern and in order, over one yarn of the first plurality of yarns, over one yarn of the third plurality of yarns, over one yarn of the first plurality of yarns and then under one yarn of the first plurality of yarns, under one yarn of the third plurality of yarns and under one yarn of the first plurality of yarns, (vi) the yarns of the second plurality of yarns have an average linear density greater than or equal to the average linear density of the yarns of the first plurality of yarns and (vii) the yarns of the third plurality of yarns have an average linear density greater than the average linear density of the yarns of the second plurality of yarns and less than three times the average linear density of the yarns of the first plurality of yarns.

The invention is also directed to composite plies fabricated using the triaxial braided fabrics described above, as well as ballistic resistant articles comprising these triaxial braided fabric.

BRIEF DESCRIPTION OF THE DRAWINGS

FIG. 1 shows a planar view of a triaxial braided fabric.

DETAILED DESCRIPTION OF THE INVENTION

Glossary of Terms

Yarn—A yarn is a continuous strand of filaments in a form suitable for processing into a fabric. A yarn is sometimes referred to as a "tow" or an "end".

Woven Fabric—The term "woven" is meant herein to be any fabric that can be made by weaving; that is, by interlacing or interweaving at least two yarns typically at right angles. Generally such fabrics are made by interlacing one set of yarns called warp yarns, with another set of yarns called weft or fill yarns. The typical woven fabric can have essentially any weave, such as, plain weave, crowfoot weave, basket weave, satin weave, twill weave, unbalanced weaves, and the like.

Triaxial Braid—a triaxial fabric comprised of interwoven braid yarns and axial yarns. The axial yarns are oriented parallel to the length of the finished fabric and are held in place by the interwoven braid yarns. The axial yarn direction is sometimes referred to as the longitudinal or machine direction.

Braid Angle—The acute angle formed between the braid yarn and the longitudinal axes or equivalently, the machine direction of the braid. For tubular braids, the longitudinal axis would be parallel to the axis of the tube. For a triaxial braid, the braid angle is defined as the acute angle between the braid yarn and the axial yarns.

Composite Fabric Ply—This is a combination of at least one triaxial braided fabric layer and at least one second layer comprising another substrate such as another fabric style or a polymeric film.

Average Linear Density—The average linear density of a plurality of yarns is the average linear density of all yarns comprising the plurality of yarns.

Fabric & Yarns

The triaxial fabric of this invention is a specific fabric that improves ballistic resistance and reduces the potential for blunt trauma. The fabric is made by a braiding process. The fabric comprises yarns. FIG. 1 shows generally at 10 a planar view of a portion of a triaxial braided fabric of the invention. The fabric comprises a first plurality of yarns 11 oriented parallel to each other within the plane of the fabric. The fabric also comprises a second plurality of yarns 12 oriented parallel to each other within the plane of the fabric. The fabric further comprises a third plurality of yarns 13 oriented parallel to each other within the plane of the fabric. The first, second and third pluralities of yarns have a yarn orientation that is different from each other. The third plurality of yarns is oriented in an axial direction.

The second plurality of yarns is interwoven with the first plurality of yarns. The third plurality of yarns is not interwoven with either the first or second pluralities of yarns. The third yarns have no crimp. The third plurality of yarns, the axial yarns, are also known as "laid-in" yarns and are held in place by the first and second plurality of yarns. Laid-in yarns are further described on page 4.5 of the Handbook of Industrial Braiding by Atkins & Pearce. Each yarn of the first plurality of yarns passes, in a repeat pattern, over one yarn of the second plurality of yarns, over one yarn of the third plurality of yarns, over one yarn of the second plurality of yarns and then under one yarn of the second plurality of yarns, under one yarn of the third plurality of yarns and then under one yarn of the second plurality of yarns. Each yarn of the second plurality of yarns passes, in a repeat pattern, over one yarn of the first plurality of yarns, over one yarn of the third plurality of yarns, over one yarn of the first plurality of yarns and then under one yarn of the first plurality of yarns, under one yarn of the third plurality of yarns and under one yarn of the first plurality of yarns.

The yarns of the first, second and third pluralities of yarns have a tenacity of from 10 to 65 grams per dtex. In some embodiments the tenacity is from 15 to 40 grams per dtex and in yet other embodiments the tenacity is from 20 to 35 grams per dtex. The yarns of the first, second and third pluralities of yarns have a yarn modulus of from 100 to 3500 grams per dtex. In some embodiments the yarn modulus is from 150 to 2700 grams per dtex. The yarns of the first, second and third pluralities of yarns preferably have an elongation to break of from 3.6 to 5.0 percent. In still some other embodiments, the elongation to break is from 3.6 to 4.5 percent.

The yarns of the first, second and third pluralities of yarns have a have a linear density of from 50 to 4,500 dtex. In some embodiments the yarn linear density is from 100 to 3500 dtex and in yet other embodiments the linear density is from 300 to 1800 dtex. The yarns of the second plurality of yarns have an average linear density greater than or equal to the average linear density of the yarns of the first plurality of yarns. The yarns of the third plurality of yarns have an average linear density greater than the average linear density of the yarns of the second plurality of yarns and less than three times the average linear density of the yarns of the first plurality of yarns. It has been discovered that when the yarns of the third plurality of yarns have an average linear density equivalent or less than the average linear density of the yarns of the second plurality, the braided triaxial fabrics lack sufficient stability for satisfactory ballistic performance. When the yarns of the third plurality are equivalent or greater than three times the average linear density of the yarns of the first plurality of yarns, then the ballistic resistance is unsatisfactory due to increased fabric tightness.

A yarn as described above may be made by assembling or roving together two precursor yarns of lower linear density.

For example two precursor yarns each having a linear density of 850 dtex can be assembled into a finished yarn having a linear density of 1700 dtex.

The fabric has a basis weight of from 30 to 800 g/sq.m. In some embodiments the basis weight of the fabric is from 45 to 500 g/sq.m. In some other embodiments the basis weight of the fabric is from 55 to 300 g/sq.m.

In some embodiments, the fabrics have a braid angle of from 50 to 70 degrees. In some other embodiments, the braid angle is from 55 to 65 degrees. In yet some other embodiments the braid angle is 60 degrees. If the braid angle is less than 50 degrees, the fabric will have an unstable structure. If the braid angle is greater than 70 degrees, the fabric will not be balanced and this will impact ballistic resistance.

Fabrics of this invention may be produced on a tubular braiding machine. Fabrics may also be made in flat form using flat braiding processes.

Fibers (Filaments)

For purposes herein, the term "fiber" is defined as a relatively flexible, macroscopically homogeneous body having a high ratio of length to width across its cross-sectional area perpendicular to its length. The fiber cross section can be any shape, but is typically circular or bean shaped. The fiber is solid, that is it is not a hollow fiber. Herein, the term "fiber" is used interchangeably with the term "filament".

The preferred fibers used in the yarns of the present invention are polymeric. Examples of polymeric fibers include aramid, polyethylene, polyazole. Copolymers and copolymer blends are also suitable for use. A preferred aramid is para-aramid.

The term aramid means a polyamide wherein at least 85% of the amide (—CONH—) linkages are attached directly to two aromatic rings. Suitable aramid fibers are described in Man-Made Fibres—Science and Technology, Volume 2, in the section titled Fibre-Forming Aromatic Polyamides, page 297, W. Black et al., Interscience Publishers, 1968. Aramid fibers and their production are, also, disclosed in U.S. Pat. Nos. 3,767,756; 4,172,938; 3,869,429; 3,869,430; 3,819,587; 3,673,143; 3,354,127; and 3,094,511.

The preferred para-aramid is poly(p-phenylene terephthalamide) which is called PPD-T. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether. In some preferred embodiments, the yarns of the composite consist solely of PPD-T filaments; in some preferred embodiments, the layers in the composite consist solely of PPD-T yarns; in other words, in some preferred embodiments all filaments in the composite are PPD-T filaments.

Additives can be used with the aramid and it has been found that up to as much as 10 percent or more, by weight, of other polymeric material can be blended with the aramid. Copolymers can be used having as much as 10 percent or more of other diamine substituted for the diamine of the aramid or as much as 10 percent or more of other diacid chloride substituted for the diacid chloride or the aramid.

Para-aramid fibers are sold under the tradenames Kevlar® available from E.I. du Pont de Nemours and Company, Wilmington, Del. and Twaron® available from Teijin Aramid, Arnhem, Netherlands.

When the polymer is polyolefin, polyethylene or polypropylene is preferred. The term "polyethylene" means a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE) or ultra high molecular weight polyethylene (UHMWPE). Polyethylene fiber is available from DSM, Greenville, N.C. and Honeywell International, Morristown, N.J. under the tradenames Dyneema® and Spectra® respectively.

Fibers may also comprise polyazole. In some embodiments, the polyazoles are polyarenazoles such as polybenzazoles and polypyridazoles. Suitable polyazoles include homopolymers and, also, copolymers. Additives can be used with the polyazoles and up to as much as 10 percent, by weight, of other polymeric material can be blended with the polyazoles. Also copolymers can be used having as much as 10 percent or more of other monomer substituted for a monomer of the polyazoles. Suitable polyazole homopolymers and copolymers can be made by known procedures.

Preferred polybenzazoles are polybenzimidazoles, polybenzothiazoles, and polybenzoxazoles and more preferably such polymers that can form fibers having yarn tenacities of 35 grams per dtex or greater. If the polybenzazole is a polybenzothioazole, preferably it is poly(p-phenylene benzobisthiazole). If the polybenzazole is a polybenzoxazole, preferably it is poly(p-phenylene benzobisoxazole) and more preferably poly(p-phenylene-2,6-benzobisoxazole) called PBO.

Preferred polypyridazoles are polypyridimidazoles, polypyridothiazoles, and polypyridoxazoles and more preferably such polymers that can form fibers having yarn tenacities of 30 gpd or greater. In some embodiments, the preferred polypyridazole is a polypyridobisazole. A preferred poly(pyridobisozazole) is poly(1,4-(2,5-dihydroxy)phenylene-2,6-pyrido[2,3-d:5,6-d']bisimidazole which is called PIPD. Suitable polypyridazoles, including polypyridobisazoles, can be made by known procedures. Para-phenylene benzobisoxazole (PBO) fiber is sold under the tradename Zylon® and is available from Toyobo, Osaka, Japan.

Other useful aromatic polymers include aromatic unsaturated polyesters such as polyethylene terephthalate, aromatic polyimides, aromatic polyamideimides, aromatic polyesteramideimides, aromatic polyetheramideimides and aromatic polyesterimides. Copolymers of any of the above mentioned classes of materials can also be used.

Liquid crystal polymer—liquid crystalline thermotropic polyesters such as those sold under the trade name Vectran® available from Kuraray America Inc., Fort Mill, S.C.

In the case of polyvinyl alcohol (PV—OH), PV—OH fibers having a weight average molecular weight of at least about 500,000, preferably at least about 750,000, more preferably between about 1,000,000 and about 4,000,000 and most preferably between about 1,500,000 and about 2,500,000 may be employed in the present invention. Usable fibers should have a modulus of at least about 160 g/denier, preferably at least about 200 g/denier, more preferably at least about 300 g/denier, and a tenacity of at least about 10 g/denier and more preferably at least about 14 g/denier and most preferably at least about 17 g/denier. PV—OH fibers having a weight average molecular weight of at least about 500,000, a tenacity of at least about 200 g/denier and a modulus of at least about 10 g/denier are particularly useful in producing ballistic resistant composites. PV—OH fibers having such properties can be produced, for example, by the process disclosed in U.S. Patent application Ser. No. 569,818, filed Jan. 11, 1984, to Kwon et al. and commonly assigned.

The fabric of this invention may also contain a blend of polymeric and/or non-polymeric yarns.

Composite Ply

A further embodiment of this invention is the generation of a composite ply that can be used in the construction of body armor. Such a composite ply could be provided as a continuous rolled good for use by body armor manufacturers. A composite ply comprises at least one triaxial braided fabric of this invention and at least one second layer comprising another substrate. The other substrate may be a different fabric type, a unidirectional fiber layer, a nonwoven fabric, a polymeric layer or a polymeric resin impregnated fabric structure. The various layers of the composite ply may be integrated into a single assembly through stitching, bonding, compression molding, or coating.

The polymeric layer may be in the form of a thin film or nonwoven that is melt-bonded or polymer coated to the triaxial fabric. Melt-bonding may be achieved via heated platen compression or heated calendering. Polymer coating may be applied from solvent based or emulsion/latex based polymers and then dried to remove solvent from the fabric. Such polymeric layers could be continuous in that they cover the entire surface of the fabric, or could be discontinuous across the surface of the fabric architecture to minimize weight and stiffness contribution to the ballistic resistant layer. Discontinuous coatings of resins include open patterns or lines of resin on the fabric, or discrete spots of resin. This can be achieved using melt adhesive films cut into open patterns that may be adhered to the fabric surface. Alternatively, solvent based polymer coatings or polymer emulsions/latexes can be transfer printed in the aforementioned discontinuous fashion onto the triaxial fabrics using gravure printing processes or the like.

Ballistic Resistant Article

Triaxial braided fabrics of this invention may be assembled into a package that forms part of a ballistic resistant article that exhibits reduced Back Face Deformation against bullet threats while also demonstrating favorable resistance from fragmentation threats. Stab or puncture resistance enhancement may also accrue. This multi-threat protective capability is difficult to achieve with conventional orthogonal warp—weft biaxial woven fabrics.

In some embodiments, the individual triaxial braid fabric layers and/or composite plies described above can be used to construct the entire ballistic body armor. In other embodiments, the individual triaxial braid fabric layers are used in conjunction with other anti-ballistic materials in a ballistic body armor article. As an example, the layers can be combined with woven plain, basket or satin weave fabrics woven from para-aramid or polyethylene yarns. The layers can also be combined with unidirectional or multiaxial fabric structures such as Kevlar® XP available from DuPont. In some embodiments, thermoplastic or thermoset films may also be incorporated into the body armor fabric assembly. Some or all of the various fabric layers comprising the body armor fabric assembly may be sewn together. The positioning of the various fabric layers comprising the body armor fabric assembly will vary depending on specific design requirements. In some embodiments, at least one triaxial braid fabric layer is located at the strike face of the body armor fabric assembly thus facing the projectile.

TEST METHODS

The following test methods were used in the following Examples.

Linear Density: The linear density of a yarn or fiber was determined by weighing a known length of the yarn or fiber based on the procedures described in ASTM D1907-97 and D885-98. Decitex or "dtex" is defined as the weight, in grams, of 10,000 meters of the yarn or fiber. Denier (d) is 9/10 times the decitex (dtex).

Yarn Mechanical Properties: The yarns to be tested were conditioned and then tensile tested based on the procedures described in ASTM D885-98. Tenacity (breaking tenacity), modulus of elasticity and elongation to break were determined by breaking yarns on an Instron® universal test machine.

Basis weight: the basis weight of the fabrics were determined by weighing a 15 inch×15 inch ply of the fabric, and calculating the weight per area of fabric as $oz/yd^2$ or $g/m^2$.

Areal Density: The test panel areal density was determined by measuring the mass of a 15 inch×15 inch panel comprised of multiple fabric or composite plies. Areal density in $lbs/ft^2$ was calculated from this measurement.

Braid angle was measured directly from the triaxial fabrics.

Ballistic Performance: Ballistic tests of the test panels were conducted in accordance with NIJ Standard 0101.06 and MIL-STD 662F for V50 and NIJ Standard 0101.06 for Back Face Deformation. The projectiles used were .44 magnum bullets and 17 grain fragment simulating projectiles (FSP). Ballistic resistance values reported as V50 is a statistical measure that identifies the average velocity at which a bullet or a fragment penetrates the armor equipment in 50% of the shots, versus non penetration of the other 50%. The parameter measured is V50 at zero degrees where the degree angle refers to the obliquity of the projectile to the target. The reported values are average values for the number of shots fired for each example. Back Face Deformation (BFD) is the depth of the depression made in a backing material when created by a non-penetrating projectile impact. The Back Face Deformation is measured from the plane defined by the front edge of the backing material fixture. In accordance with the NIJ standard the value is not allowed to exceed 44 mm. Back Face Deformation testing was performed at velocities of 435±9 m/s (1430±30 ft/s) on targets placed against a Roma Plastilina clay witness. For panels tested against 17 grain projectiles, the panel was gripped in place about the perimeter using a frame and clamp assembly.

EXAMPLES

For the examples and comparative examples presented below, the triaxial braid structures were generated using a tubular braiding process. This braiding operation generated a tubular fabric, with braid yarns oriented in a helical fashion about the tube during the braiding process, and axial yarns oriented parallel to the axis of the tubular braid during its formation. To generate flat fabric for constructing ballistic test panels, the tubular braid was slit along the side, and the resulting flat fabric was cut to the desired size.

Examples prepared according to the current invention are indicated by numerical values. Control or Comparative Examples are indicated by letters.

Comparative Example A

A 15 in×15 in (38×38 cm) square ballistic test panel was prepared from 26 layers of greige plain weave fabric woven from Kevlar KM2 Plus fiber yarn having a linear density of 667 dtex (600 denier). The fabric had a yarn count of 34 ends per inch (13.4 ends per cm) in the warp, then first plurality of yarns, and 34 ends per inch (13.4 ends per cm) in the fill, the second plurality of yarns. There was no third plurality of yarns. The fabric was produced by Lincoln Fabrics, Inc. Geneva, AL. The fabric had measured extracted yarn tenacities of 26.9 g/denier (29.9 g/dtex) warp and 27.1 g/denier (30.2 g/dtex) fill, and an areal density of 5.65 oz./sq.yd. (192 g/m$^2$). Individual square fabric layers were generated by cutting along the warp and fill direction (having warp and fill fiber yarns parallel to the sides of the square). Fabric layers were arranged with warp and fill fibers oriented in the same direction for all fabric layers in the stack. The fabric layers were stitched together about the perimeter of the panel ½ in (1.27 cm) from the edge. The areal density of the panel was 5.02 kg/sq.m. (1.02 lbs/sq.ft). Ballistic resistance performance against .44 magnum bullets was evaluated. The V50 and Back Face Deformation results are shown in Table 1.

Comparative Example B

A 15 in×15 in (38×38 cm) square ballistic test panel was prepared from 32 layers of greige plain weave fabric woven from Kevlar KM2 Plus fiber yarn having a linear density of 666 dtex (600 denier). The fabric had a yarn count of 28 ends per inch (11.0 ends per cm) in the warp, the first plurality of yarns, and 28 ends per inch (11.0 ends per cm) in the fill, the second plurality of yarns. There was no third plurality of yarns. The fabric was produced by Lincoln Fabrics, Inc. Geneva, Ala. The fabric had measured extracted yarn tenacities of (27.7) g/denier (30.8 g/dtex) warp and 27.4 g/denier (30.5 g/dtex) fill, and an areal density of (4.46) oz./sq.yd. (151 g/m$^2$). Individual square fabric layers were generated by cutting along the warp and fill direction (having warp and fill fiber yarns parallel to the sides of the square). Fabric layers were arranged with warp and fill fibers oriented in the same direction for all fabric layers in the stack. The fabric layers were stitched together about the perimeter of the panel ½ in (1.27 cm) from the edge. The areal density of the panel was 4.93 kg/sq.m. (1.01 lbs/sq.ft). Ballistic resistance performance against .44 magnum bullets was evaluated. The V50 and Back Face Deformation results are shown in Table 1.

Comparative Example C

A 15 in×15 in (38×38 cm) square ballistic test panel was prepared from 26 layers of braided triaxial fabric generated from a tubular braid produced by A&P Technology, Inc. The yarns used to generate the triaxial fabric were 600 denier Kevlar® KM2 Plus fiber. The braid construction consisted of a braid angle of 61.5 degrees, a single 600 denier Kevlar KM2 yarn was used for each braid yarn, a single 600 denier Kevlar KM2 yarn in each axial position, and a basis weight of 5.59 oz./sq.yd. (190 g/m$^2$). To produce the flat triaxial braid fabric, the 4.85" diameter tubular braid was slit along one side in the axial direction. From the resulting flat fabric, 15 in×15 in plies were cut and stacked with all plies oriented in the same direction. The fabric layers were stitched together about the perimeter of the panel ½ in (1.27 cm) from the edge. The areal density of the panel was 4.94 kg/sq.m. (1.01 lbs/sq.ft). Ballistic resistance performance against .44 magnum bullets was evaluated. The V50 and Back Face Deformation results are shown in Table 1.

Comparative Example D

A 15 in×15 in (38×38 cm) square ballistic test panel was prepared from 19 layers of a braided triaxial fabric generated from a tubular braid produced by A&P Technology, Inc. The yarns used to fabricate this braid were Kevlar® KM2 Plus fiber. The first and second pluralities of yarns (braid yarns) had a linear density of 666 dtex (600 denier). The third plurality of yarns (axial yarns) had a linear density of 1998 dtex (1800 denier) assembled from three yarns of 667 dtex. The braid construction consisted of a braid angle of (64.5) degrees, and a basis weight of (7.72) oz./sq.yd. (262 gsm). To produce the flat triaxial braid fabric, the 4.85" diameter tubular braid was slit along one side in the axial direction. From this fabric, 15 in×15 in plies were cut and stacked with all plies oriented in the same direction. The fabric layers were stitched together about the perimeter of the panel ½ in (1.27 cm) from the edge. The areal density of the panel was 5.02 kg/sq.m. (1.02 lbs/sq.ft). Ballistic resistance performance against .44 magnum bullets was evaluated. The V50 and Back Face Deformation results are shown in Table 1.

Example 1

A 15 in×15 in (38×38 cm) square ballistic test panel was prepared from 22 layers of a braided triaxial fabric generated from a tubular braid produced by A&P Technology, Inc. The yarns used to fabricate the braid were Kevlar® KM2 Plus fiber. The first and second pluralities of yarns (braid yarns) both had a linear density of 666 dtex (600 denier). The third plurality of yarns (axial yarns) had a linear density of 1332 dtex (1200 denier) assembled from two yarns of 666 dtex. The braid construction consisted of a braid angle of 63 degrees and a basis weight of 6.62 oz./sq.yd (224 gsm). To produce the flat triaxial braid fabric, the 4.85" diameter tubular braid was slit along one side in the axial direction. From this fabric, 15 in×15 in plies were cut and stacked with all plies oriented in the same direction. The fabric layers were stitched together about the perimeter of the panel ½ in (1.27 cm) from the edge. The areal density of the panel was 4.97 kg/sq.m. (1.01 lbs/sq.ft). Ballistic resistance performance against .44 magnum bullets was evaluated. The V50 and Back Face Deformation results are shown in Table 1.

Comparative Example E

The test panel was fabricated as described in Comparative Example A using 27 plies of fabric. The areal density of the panel was 5.17 kg/sq.m. (1.05 lbs/sq.ft). Ballistic resistance performance against 17 grain FSP's was evaluated. The V50 results are shown in Table 2.

Comparative Example F

The test panel was fabricated as described in Comparative Example B using 33 plies of fabric. The areal density of the panel was 5.17 kg/sq.m. (1.05 lbs/sq.ft). Ballistic resistance performance against 17 grain FSP's was evaluated. The V50 results are shown in Table 2.

Comparative Example G

The test panel was fabricated as described in Comparative Example C using 27 plies of the triaxial braid fabric. The areal density of the panel was 5.17 kg/sq.m. (1.05 lbs/sq.ft). Ballistic resistance performance against 17 grain FSP's was evaluated. The V50 results are shown in Table 2.

Comparative Example H

The test panel was fabricated as described in Comparative Example D using 20 plies of the triaxial braid fabric. The areal density of the panel was 5.22 kg/sq.m. (1.06 lbs/sq.ft). Ballistic resistance performance against 17 grain FSP's was evaluated. The V50 results are shown in Table 2.

Example 2

The test panel was fabricated as described in Example 1 using 23 plies of the triaxial braid fabric. The areal density of the panel was 5.17 kg/sq.m. (1.05 lbs/sq.ft). Ballistic resistance performance against 17 grain FSP's was evaluated. The V50 results are shown in Table 2.

TABLE 1

| | Areal | | Backface Performance | |
|---|---|---|---|---|
| Example | Density (kg/sq · m) | V50 (m/s) | Velocity (m/s) | BFS (mm) |
| Comparative Example A | 5.02 | 466 | 431<br>438 | 48<br>52 |
| Comparative Example B | 4.99 | 490 | 435<br>430 | 50<br>51 |
| Comparative Example C | 4.97 | 459 | 431<br>428 | Complete<br>46 |
| Comparative Example D | 5.02 | 456 | 438<br>437 | 50<br>Complete |
| Example 1 | 4.97 | 505 | 438<br>436 | 39<br>41 |

Complete indicates that there was complete penetration by the bullet.

TABLE 2

| | Example | | | | |
|---|---|---|---|---|---|
| | Comparative Example E | Comparative Example F | Comparative Example G | Comparative Example H | Example 2 |
| Areal Density (kg/sq · m.) | 5.17 | 5.17 | 5.17 | 5.22 | 5.17 |
| V50 (m/s) | 610 | 631 | 601 | 608 | 640 |

Based on the 44 Magnum ballistic testing presented in Table 1 for panels of nearly equivalent areal density, the panel of Example 1 fabricated from triaxial braid fabric having axial position yarns with twice the average denier as those used for the braid yarns exhibited improved V50 performance and reduced backface performance compared to panels constructed with triaxial braid fabric having equivalent denier braid and axial yarns (Comparative Example C), and a panel fabricated from triaxial braid fabric having an axial yarn denier of three times that of the braid yarn deniers (Comparative Example D). Additionally, the Example 1 panel demonstrated improved V50 performance over Comparative Example A and B panels generated using biaxial woven fabric typically used in ballistic vest constructions.

Based on 17 grain fragment ballistic performance presented in Table 2 for panels of nearly equivalent areal density, the example 2 panel fabricated from triaxial braid fabric having axial position yarns with twice the denier as those used for the braid yarns exhibited improved V50 performance over panels fabricated from the other triaxial braid fabrics (Comparative Examples G and H), as well as both panels fabricated from biaxial fabrics (Comparative Examples E and F).

Based on this investigation, it is evident that a triaxial braid fabric having optimal antiballistic performance can be achieved based on the yarn denier chosen for the axial positions relative to the yarn deniers used to generate the braid yarns. It has been clearly demonstrated that for triaxial braid fabrics constructed of braid yarns of equivalent average denier, positioning yarn with twice the denier in each axial position resulted in soft body armor test panels with improved ballistic performance over panels constructed of triaxial braid fabric having axial yarns of identical denier to that of the braid yarns. Increasing the denier of yarn in each axial position to three times that of the braid yarns resulted in inferior ballistic performance. The improved ballistic performance results of this triaxial braid structure was unanticipated based on earlier investigations (both experimental and through simulation) of triaxial fabric constructions that suggested the ballistic performance of triaxial fabrics should be lower than biaxial woven fabrics (two interwoven yarn pluralities, the yarns from one plurality being oriented at an angle of 90 degrees relative to the yarns of the other plurality).

This improved ballistic performance may be the result of a more efficiently constructed ballistic structure, where equivalent yarn denier in each axial position resulted in triaxial braids with low stability, where yarns may translate too easily during the ballistic event, and/or the triaxial braid fabric lacks the stability to endure multi-shot integrity during panel testing. Increasing the denier of the axial yarns to three times that of the braid yarns resulted in a triaxial braid structure that was noticeably tighter and resulted in greater crimp amplitude for the braid yarns. The tightness of these constructions or the inefficiency of the resulting fabric architecture resulting from too great of yarn denier in the axial position may have resulted in the reduced ballistic V50 performance. This investigation suggests that optimal triaxial braid constructions can be achieved through having axial yarn deniers greater than one times the average braid yarn denier for improved multi-shot stability and fabric cover, but less than three times the average of the individual braid yarns for reduced stiffness and crimp amplitude.

What is claimed is:

1. A triaxial fabric comprising:

a first plurality of yarns oriented parallel to each other within the plane of the fabric, a second plurality of yarns oriented parallel to each other within the plane of the fabric and a third plurality of yarns oriented parallel to each other within the plane of the fabric wherein, (i) the first, second and third pluralities of yarns have a yarn orientation that is different from each other, (ii) the second plurality of yarns is interwoven with the first plurality of yarns, (iii) the third plurality of yarns is not interwoven with either the first or second pluralities of yarns, (iv) each yarn of the first plurality of yarns passes, in a repeat pattern and in order, over one yarn of the second plurality of yarns, over one yarn of the third plurality of yarns, over one yarn of the second plurality of yarns and then under one yarn of the second plurality of yarns, under one yarn of the third plurality of yarns and then under one yarn of the second plurality of yarns, (v) each yarn of the second plurality of yarns passes, in a repeat pattern and in order, over one yarn of the first plurality of yarns, over one yarn of the third plurality of yarns, over one yarn of the first plurality of yarns and then under one yarn of the first plurality of yarns, under one yarn of the third plurality of yarns and under one yarn of the first plurality of yarns, (vi) the yarns of the second plurality of yarns have an average linear density greater than or equal to the average linear density of the yarns of the first plurality of yarns and (vii) the yarns of the third plurality of yarns have an average linear density greater than the average linear density of the yarns of the second plurality of yarns and less than three times the average linear density of the yarns of the first plurality of yarns, wherein the yarns are of fibers made from aromatic polyamide, polyazole, polyolefin, aromatic unsaturated polyester, aromatic polyimide, rayon, liquid crystal polymer, polyacrylonitrile, polyvinylalcohol, ceramic or copolymers thereof.

2. The fabric of claim 1 wherein the aromatic polyamide is para-aramid.

3. The fabric of claim 1 wherein the polyolefin is ultra high molecular weight polyethylene.

4. A ballistic or puncture resistant article comprising at least one layer of the fabric of claim 1.

* * * * *